US005632426A

United States Patent [19]

Beletsky et al.

[11] Patent Number: 5,632,426

[45] Date of Patent: May 27, 1997

[54] HOLSTER WITH IMPROVED BELT LOOP LOCK AND BROADLY ADJUSTABLE THUMB BREAK STRAP

[75] Inventors: Robert J. Beletsky; Anthony G. Lefeber, both of Temecula, Calif.

[73] Assignee: Bianchi International, Temecula, Calif.

[21] Appl. No.: 374,928

[22] Filed: Jan. 18, 1995

[51] Int. Cl.[6] ..... F41C 33/04

[52] U.S. Cl. ..... 224/243; 224/192; 224/911

[58] Field of Search ..... 224/192, 193, 224/243, 911, 912, 232, 234, 242, 253, 904, 198, 191, 226, 238

[56] References Cited

U.S. PATENT DOCUMENTS

| | | | |
|---|---|---|---|
| 3,011,687 | 12/1961 | Boyt | 224/243 |
| 3,565,303 | 2/1971 | Kippen | 224/911 |
| 4,312,466 | 1/1982 | Clark | 224/192 |
| 4,696,419 | 9/1987 | Holtzclaw, Jr. et al. | 224/243 |
| 4,905,880 | 3/1990 | Cupp | 224/192 |
| 5,236,113 | 8/1993 | Wisser | 224/193 |

*Primary Examiner*—Henry J. Recla
*Assistant Examiner*—Charles R. Eloshway
*Attorney, Agent, or Firm*—Wagner & Middlebrook

[57] ABSTRACT

A holster is disclosed employing a formed composite of fabric-foam and fabric in which the outer face is formed to match the contour of a hand gun to carried in the holster while the inner face is generally flat. A belt loop assembly is secured to the inner face including a generally "Y" shape with an opening between the arms of the "Y". Hook or pile fastener fabric is located within the belt loop assembly. A thumb break or strap includes an end which extends through the opening into the belt loop and is held in place by contact with the hook and pile fastener. The thumb break is angularly adjustable within the belt loop and securable at various angles by the hook and pile fastener. The belt loop assembly, most importantly defines a belt loop and the thumb break and the hook and pile fastener cooperate to restrict the size of the belt loop and provide restriction against unwanted movement of the holster on a belt.

8 Claims, 2 Drawing Sheets

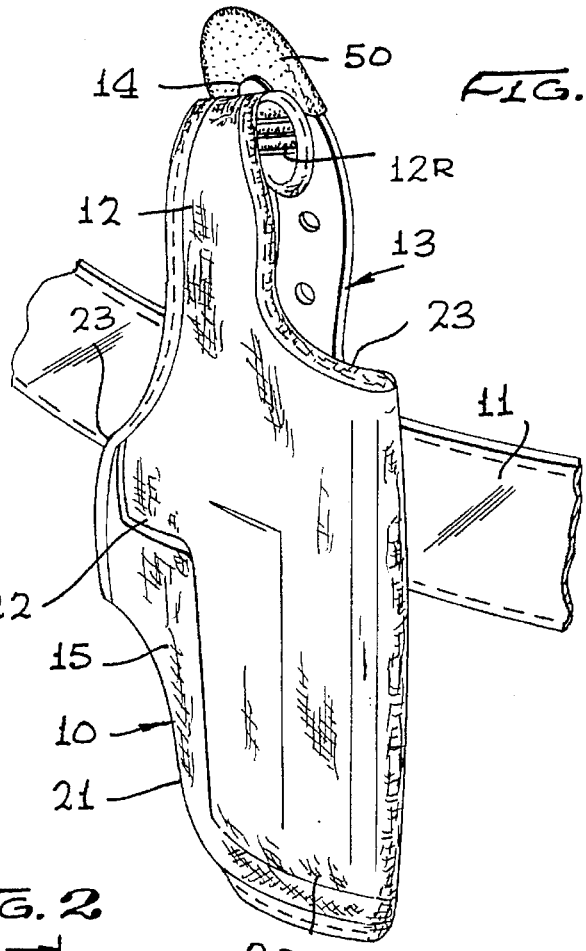
FIG. 1
FIG. 2
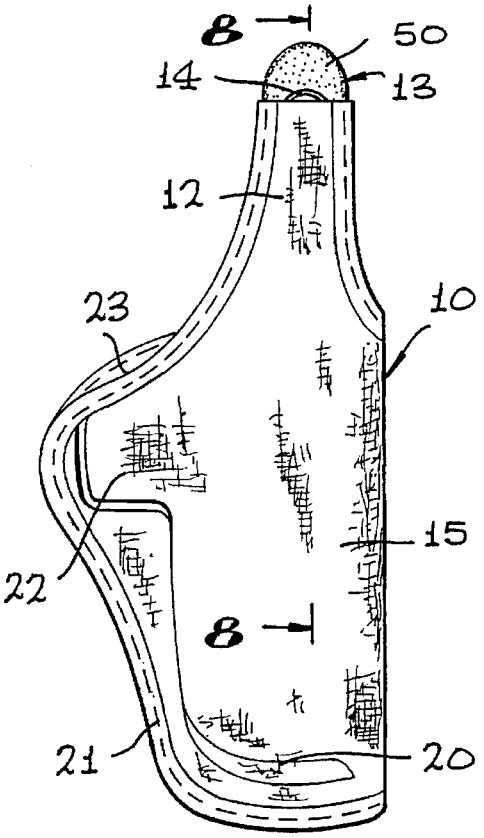
FIG. 3
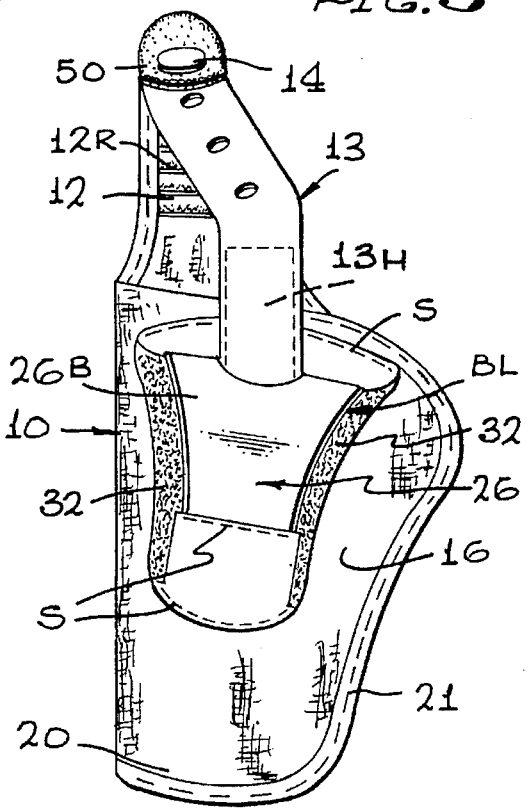

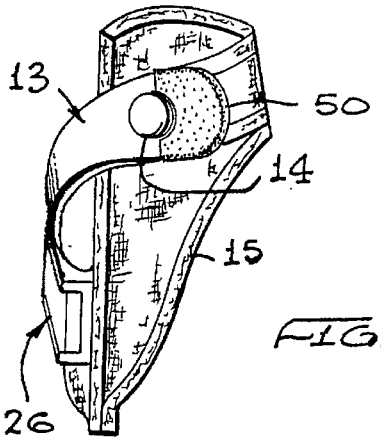
FIG. 4
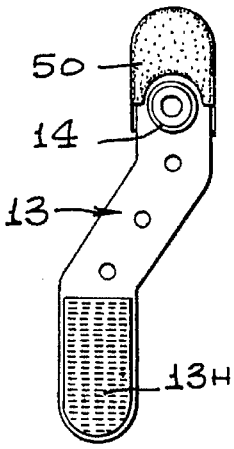
FIG. 5a
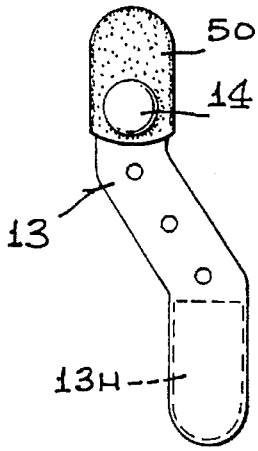
FIG. 5b
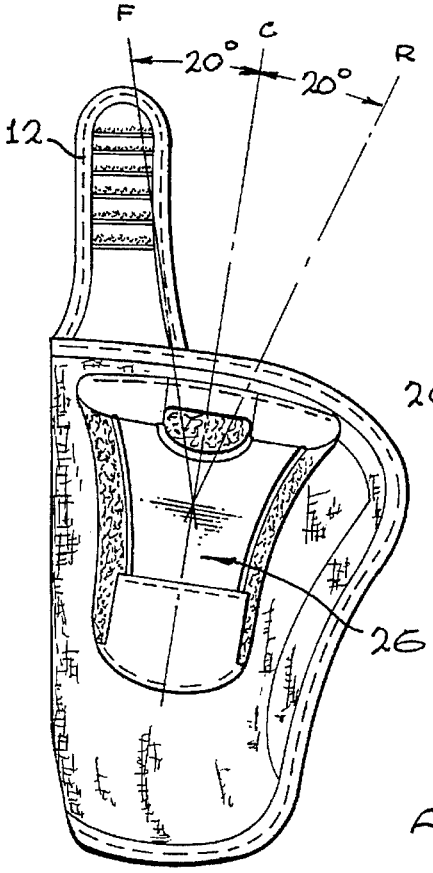
FIG. 6
FIG. 7
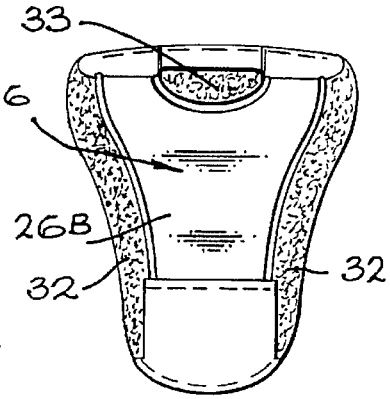
FIG. 9
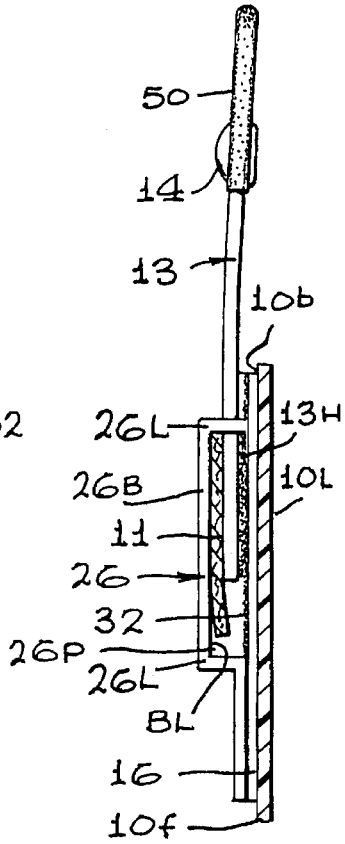
FIG. 8
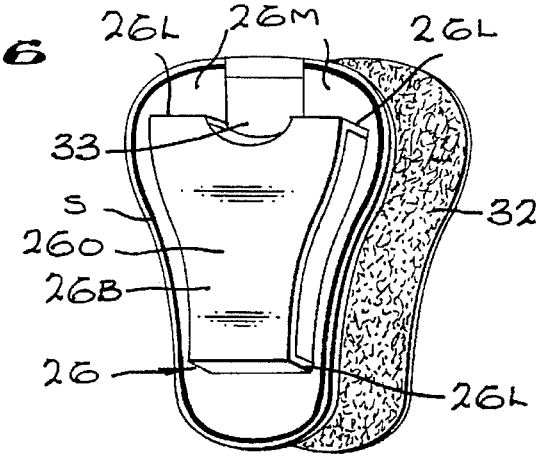

HOLSTER WITH IMPROVED BELT LOOP LOCK AND BROADLY ADJUSTABLE THUMB BREAK STRAP

BACKGROUND OF THE INVENTION

The need for improved law enforcement and sporting holsters continues to be recognized for designs having improved wearability, attractiveness, conformance to present and new handgun designs and to utilize new materials as they become available. I have continued this advance in the development of foam molded pouches and holsters described in application Ser. No. 08/004,106 filed Jan. 13, 1993 for MOLDED LAMINATED POUCH, now U.S. Pat. No. 5,351,868 issued on Oct. 4, 1994.

BRIEF DESCRIPTION OF THE INVENTION

I have found that a composite fabric-foam-fabric holster body with the exterior surface of ballistic nylon, the high density, closed cell foam layer being of thermally and pressure responsive to take and hold a precise shape in both the compressed and uncompressed areas and a smooth long wearing knit fabric lining meets all of the above criteria. The ability to mold ballistic weave fabric covered foam to conform with the particular handgun provides not only a solid handgun position, but presents a very attractive exterior appearance with a durable surface and an inner liner which wears well and does not damage handgun finishes.

It has been generally the practice in composite foam molded holsters to have both sides formed to configure with the handgun details. Examples of such holsters are shown in U.S. Pat. Nos. 4,885,947 and 4,489,948 to C. L. Cook.

I have found that given the capability to foam mold a holster having a ballistic weave nylon exterior surface with precisely located uncompressed interior risers in the order of ⅝" in height and sharply rounded corners without damage, allows one face of the holster body to conform precisely to this intended handgun and the other face remain virtually flat. This simplifies the foam molding process and, in fact, provides a relatively flat rear face of the holster which lies against the wearer's body. A separate belt loop subassembly may easily be attached to the holster body on its flat side. The handgun remains snug within the holster given the detailed conformance to the handgun shape on one face. The holster, itself, lies flat and close against the wearer's body, as well. This feature combined with a suitably adjustable strap provides a truly effective and attractive holster.

Given a flat inner face of the holster, attaching a belt loop as by cementing or stitching or both is facilitated. It is also possible to have an improved belt loop with a higher degree of support for the holster and with assurance that when placed on a belt and moved to its desired position, it will remain at that position despite strenuous movements as by a law enforcement officer or sportsman.

I have determined that a versatile belt loop assembly and improved retainer strap mounting can be accomplished when the belt loop has two side openings for the belt passage and a single central top opening for the passage of the retention strap is truly adjustable and effective. The belt loop member appears to be of generally "Y" shape when seen in a rear elevational view. The opening or space between the two arms of the "Y" is utilized to insert an adjustable end of the strap or thumb break of the holster. The entrance angle and thus the angle of the strap may be changed to match the hammer region or slide of the particular handgun and to suit the wearer's preferences.

I have also found that by providing a layer of hook and pile fabric on the generally flat surface of the holster beneath the "Y" shaped belt loop, the strap or thumb break can carry a mating hook or pile fastener to secure it to the holster body. The hook or pile fabric on the holster body can engage the inner face of the belt tending to hold it in position. The strap or thumb break which enters the belt loop through the space between the arms of the "Y" provides additional thickness to secure the holster on the belt at a selected position. The retention strap with its added thickness within the belt loop and the belt cooperate to hold each other from movement after positioning and adjusting and when in place.

The cooperation between the generally planar inner face of the holster, the "Y" shaped belt loop and the strap or thumb break provide effective positioning and support for the holster on the belt. It soon becomes apparent the holster is held rather rigidly by three point support. Additionally, I have found that and S shaped relatively rigid thumb break engaging a compressed foam integral strap, provides a vastly superior and flexible strap arrangement for a variety of handguns to be carried in the same holster.

BRIEF DESCRIPTION OF THE DRAWING

This invention may be more clearly understood from the following detailed description and by reference to the drawings in which:

FIG. 1 is a perspective view of a holster in accordance with this invention;

FIG. 2 is an outer face elevational view thereof;

FIG. 3 is an inner face elevational view thereof;

FIG. 4 is a top plan view of the holster with the retention strap secured;

FIGS. *5a* and *5b* are the inner and outer faces, respectively, of a thumb break which forms part of the strap of the holster as removed from the holster of FIG. 5;

FIG. 6 is an inside elevational view of the holster belt loop assembly;

FIG. 7 is an elevational view of the belt loop assembly of FIGS. 3 and 4;

FIG. 8 is an enlarged fragmentary sectional view of FIGS. 1–3 taken along lines 8—8 of FIG. 2; and FIG. 9 is a perspective exploded view of an alternate embodiment belt loop assembly.

DETAILED DESCRIPTION OF THE INVENTION

Now referring to FIG. 1 in combination with FIGS. 2 and 3, a holster generally designated 10 may be seen on a belt 11 including an integral strap 12 and a thumb break or secondary strap 13 with a snap fastener 14 securing the thumb break 13 to the strap 12. The holster 10 has its outer face 15 contoured to the shape of the particular handgun type for which it is intended, e.g., revolver or automatic handgun. The holster 10, preferably has a closed muzzle region 20, a body closing seam line 21, of FIG. 2, a trigger guard enclosing portion 22 and a top opening 23 for handgun insertion and removal.

Note, in FIGS. 1 and 2, that the integral strap 12 includes on its inner face, a series of transverse ribs or rolls 12R which are relatively uncompressed foam separated by compressed lines which provide for effective curvature around the hammer region of the handgun carried. By way of contrast, the thumb break 13 is relatively stiff and generally S or angled shaped as may best be seen in FIGS. 3, *5a* and *5b*. The flexibility of the integral strap 12 and the relative rigidity of the thumb break 13 insure easy thumb action release of the strap 12-13 in the handgun drawing process. The thumb break 13 also is stiffened at its end by molded plastic tip 50, best seen in FIGS. 3, 5*a* and 5*b*. The transverse ribs 12R are produced in accordance with the teaching of the U.S. Patent for MOLDED LAMINATED POUCHES, referenced above, and the thumb break tip is the subject of U.S. Design Pat. No. D290,311, issued Jun. 16, 1987.

The holster 10 has a generally flat rear face 16, first seen in FIG. 3, with a belt loop subassembly 26 secured to the inner face 16, preferably by stitch lines S of FIG. 3. The belt loop subassembly 26 comprises the molded plastic body 26B and a hook or pile fabric underlayer 32. Both the body 26B and the underlayer 32 are sewn to the holster 10 at the same time by stitch lines S. The underlayer 32 may also be cemented by a suitable adhesive to the holster 10. This is easily accomplished since the inner face 16 of the holster 10 is generally flat.

The body 26B also includes a pair of upstanding legs 26L, best seen in FIGS. 8 and 9, which extend upward from mounting surfaces 26M through which the stitch lines S penetrate to secure the belt loop subassembly 26 to the holster. The legs 26L are of approximately one quarter inch in inside height to define the tunnel or belt loop BL for receiving the belt 11. The pile 32 fills a part of the belt loop opening BL and the thumb break 13 with its mating hook layer 13H of FIGS. 5*a*, providing additional restriction to the tunnel-like space of the belt loop as illustrated in FIG. 8. The thumb break 13 with its hook or pile fastener fabric 13H and the hook or pile fastener on the face 16 of the holster, together, secure the thumb break 13 from moving on the holster 10 and the holster 10 from unwanted movement on the belt 11. The slight flexibility of the body 26B aids in intended adjustment of the holster 10 on the belt 11 by the wearer.

One of the important features of this holster is the fact that the thumb break 13 is separable from the holster 10 as is shown in FIGS. 5*a* and 5*b* and fully adjustable in angle by its passage through the opening 33 between the upper legs 26L of the belt loop subassembly 26. The side edges of the opening 33, as illustrated in FIG. 6, limit movement of the thumb break 13 either forward to the dashed line F as much as 20 degrees from the centerline C of the belt loop subassembly 26 or backward to the dashed line R in the same amount. This degree of adjustment is far greater than is required to adjust the angle of the retention strap of any conventional handgun.

The lower end of the thumb break 13 may be pivoted, forward or backward over the 40-degree arc with the hook or pile fabric 13H still engaging its mating material 32 on the surface 16. The only limitation in angle of the thumb break 13 is the size of the pile fabric fastener 32 and the extent to which the integral strap 14 may pivot. A typical intermediate position is illustrated in FIG. 3 for use with a 3–3½" medium automatic such as a Colt Mustang.

The adjustability of the thumb break 13 is also enhanced by a) its S or angled shape;

b) the presence of alternate snap fasteners for shortening the thumb break for short receiver handguns; and c) its slight flexibility being fabricated of ⅛th inch thick and one inch width acytl copolymer such as the material sold by the du Pont Company of Wilmington, Del. under the trademark Delrin.

The thumb break can flex to meet the integral strap 12 whenever required to secure the handgun over the hammer for a revolver or the rear of the slide for an automatic handgun.

An alternate form belt loop member 260 is shown in FIG. 7. It is similar to the member 26 of FIGS. 3, and 6 except that it has a continuous stitched line S around the periphery. The belt loop member 260 is easier to attach by a single continuous sewn seam. This embodiment eliminates the need for any adhesive bonding of the pile fabric 32 to the holster body although adhesive bonding still is an option.

Now, for a clear understanding of the relationship of the thumb break 13, the belt loop subassembly 26, the hook or pile fabric 13H and 32, reference is made to FIG. 8. Also this figure shows a cross section of the holster body and its three layers including a compressed foam middle section 10*f* with a ballistic fabric outer cover 10*b* and preferably on the inner surface, a fabric liner 10L. Secured to the face 16 in the region of the belt loop 26 is the hook or pile fabric 32 underlying the entire belt loop 26 having three upstanding legs 26L, one at the bottom and two at the top and an elevated belt enclosing portion 26*b*. The lower end of the thumb break 13 may be seen in FIG. 8 extending through the opening 33 into the belt retaining passage 26*p*. Mating hook or pile fabric fastener 13H engages the hook or pile fabric 32 and the added thickness of the thumb break 13 and its hook or pile fabric 13H tends to confine a belt 11 against the belt loop 26 in the central region 26*b*. Therefore, the belt loop 26 in the hook and pile fabric 32 and the 13H and the thumb break 13 do hold the holster on the belt B once it is positioned. The belt 11 is held in the triangle defined by the belt loop surfaces 26L.

Given the features of this holster described above, a single design incorporating its features will precisely and reliably carry virtually dozens of different handguns with equal ease.

The above described embodiments of the present invention are merely descriptive of its principles and are not to be considered limiting. The scope of the present invention instead shall be determined from the scope of the following claims including their equivalents.

What is claimed is:

1. A holster comprising a body including an outer face formed to conform to an outline of at least a portion of a barrel and body of a handgun to be carried in the holster and an inner face which includes a substantially flat belt loop area;

a belt loop assembly secured to said inner face in said substantially flat area for receiving a belt upon which the holster is to be worn;

said belt loop assembly comprising a pair of arms having a generally "Y" shape, said arms being connected to a base portion which is secured to the holster, said base portion and said pair of arms forming an opening therebetween;

a first strap member extending from the outer face of said body;

a second strap member removably secured to the inner face of said holster;

said second strap extending through the opening formed by said arms and said base portion and positioned to be angularly adjustable within said belt loop assembly and restrained from movement by contact with a belt within said belt loop.

2. A holster in accordance with claim 1 wherein said second strap and said base portion include mating hook and pile fabric fasteners thereon, the fastener on said base portion extending beneath the belt loop assembly in a region of the opening between said arms and said base portion.

3. A holster in accordance with claim 1 wherein said belt loop assembly includes an upstanding portion defining the belt loop.

4. A holster in accordance with claim 3 wherein said second strap and said base portion include mating hook and pile fabric fasteners thereon, the fastener on said base portion extending beneath the belt loop assembly in a region of the opening between said arms and said base portion, said belt loop enclosing a portion of said fastener on said base portion and a portion of said second strap.

5. A holster in accordance with claim 3 wherein said second strap and said base portion include mating hook and pile fabric fasteners thereon, the fastener on said base portion extending beneath the belt loop assembly in a region of the opening between said arms and said base portion, said second strap being angularly adjustable within said opening while remaining in contact with the fastener on said base portion.

6. A holster in accordance with claim 1 wherein said first strap is formed integrally with said body.

7. A holster in accordance with claim 1 wherein said second strap is generally "S" shaped with one end region thereof extending into said opening and the opposite end region including fastening means for engagement with said first strap.

8. A holster in accordance with claim 3 wherein said upstanding portion defines the arms and base of the generally "Y" shaped belt loop assembly.

* * * * *